US008272098B2

(12) United States Patent
Stewart

(10) Patent No.: US 8,272,098 B2
(45) Date of Patent: Sep. 25, 2012

(54) HOSE AND WAND ASSEMBLY FOR A SURFACE TREATING APPLIANCE

(75) Inventor: Neil Andrew Stewart, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 552 days.

(21) Appl. No.: 12/520,433

(22) PCT Filed: Nov. 29, 2007

(86) PCT No.: PCT/GB2007/004574

§ 371 (c)(1),
(2), (4) Date: Aug. 6, 2009

(87) PCT Pub. No.: WO2008/078066

PCT Pub. Date: Jul. 3, 2008

(65) Prior Publication Data

US 2010/0095479 A1 Apr. 22, 2010

(30) Foreign Application Priority Data

Dec. 22, 2006 (GB) ..... 0625806.5

(51) Int. Cl.
*A47L 9/02* (2006.01)

(52) U.S. Cl. ..... 15/414; 451/314

(58) Field of Classification Search ..... 15/414, 15/314, 377, 319; 174/47; 285/7
See application file for complete search history.

(56) References Cited

U.S. PATENT DOCUMENTS 2,637,062 A 5/1953 Sutton et al.
2,890,264 A 6/1959 Duff
3,017,654 A 1/1962 Allenby at al.
3,614,705 A * 10/1971 Descarries et al. ..... 439/23
4,152,014 A 5/1979 Soeffker
4,494,270 A 1/1985 Ritzau et al.
4,787,117 A 11/1988 Westergren
4,881,909 A 11/1989 Blackman
4,980,945 A 1/1991 Bewley (Continued)

FOREIGN PATENT DOCUMENTS

DE 6752338 2/1969

(Continued)

OTHER PUBLICATIONS

GB Search Report, dated Jul. 4, 2007, directed to corresponding GB application No. GB0625806.5; (1 page).

(Continued)

*Primary Examiner* — Dung Van Nguyen
(74) *Attorney, Agent, or Firm* — Morrison & Foerster LLP

(57) ABSTRACT

A vacuum cleaner has a hose and wand assembly onto which a floor tool may be attached. The wand includes a plurality of telescoping tubes which can slide between retracted and extended positions. In order to be able to transmit power and signals from the vacuum cleaner to the end of the wand assembly, conductors are provided in a channel in the hose. The hose is connected to the interior of the wand, just beyond the last telescoping joint, with the conductors extending beyond the end of the hose to a connector at the far end of the wand. This arrangement automatically provides a reliable electrical connection down the wand. Previously, electrical conductors were not employed with this type of wand as it was not straightforward to provide electrical connections across the telescoping parts.

28 Claims, 8 Drawing Sheets

U.S. PATENT DOCUMENTS

| | | | | |
|---|---|---|---|---|
| 5,069,635 | A | 12/1991 | Holden et al. | |
| 6,148,474 | A | 11/2000 | Ohara et al. | |
| 7,552,806 | B2 * | 6/2009 | Tong | 191/12 R |
| 2004/0194251 | A1 * | 10/2004 | Overvaag et al. | 15/377 |
| 2005/0022338 | A1 | 2/2005 | Muhlenkamp et al. | |
| 2005/0060838 | A1 | 3/2005 | Walter et al. | |
| 2010/0095474 | A1 | 4/2010 | Stewart | |

FOREIGN PATENT DOCUMENTS

| | | |
|---|---|---|
| DE | 2256231 | 5/1974 |
| DE | 3009648 | 9/1981 |
| DE | 4037889 | 12/1991 |
| DE | 19738329 | 3/1999 |
| DE | 10162455 | 7/2003 |
| EP | 0125994 | 11/1984 |
| EP | 1 365 676 | 12/2003 |
| EP | 1527727 | 5/2005 |
| EP | 1618825 | 1/2006 |
| GB | 878360 | 9/1961 |
| GB | 2400310 | 10/2004 |
| GB | 2416680 | 2/2006 |
| JP | 5-84198 | 4/1993 |
| JP | 11-267075 | 10/1999 |
| JP | 2000-107107 | 4/2000 |
| JP | 2000-166831 | 6/2000 |
| NL | 7501422 | 8/1975 |
| WO | WO-96/25083 | 8/1996 |
| WO | WO-02/071913 | 9/2002 |
| WO | WO-03/039315 | 5/2003 |
| WO | WO-2004/096002 | 11/2004 |

OTHER PUBLICATIONS

GB Search Report, dated Mar. 27, 2007, directed to corresponding GB application No. GB0625806.5; (1 page).

International Preliminary Report on Patentability dated Dec. 29, 2008, directed to corresponding international application No. PCT/GB2007/004574; (11 pages).

International Search Report mailed Apr. 17, 2008 directed to corresponding international application No. PCT/GB2007/004574; (6 pages).

Stewart, N. A., U.S. Office Action mailed Aug. 12, 2010, directed to U.S. Appl. No. 12/520,474; 6 pages.

U.S. Office Action mailed Jan. 21, 2011, directed to U.S. Appl. No. 12/520,474; 6 pages.

GB search report dated Mar. 28, 2007 directed to related application No. GB0625804.0; (1 page).

International Search Report and Written Opinion mailed on May 2, 2008 directed to related application No. PCT/GB2007/004572; (12 pages).

International Preliminary Report on Patentability dated Apr. 2, 2009, directed to related international application No. PCT/GB2007/004572; (8 pages).

Stewart, N., U.S. Office Action, mailed Dec. 19, 2011, directed to U.S. Appl. No. 12/520,474; 5 pages.

* cited by examiner

HOSE AND WAND ASSEMBLY FOR A SURFACE TREATING APPLIANCE

REFERENCE TO RELATED APPLICATIONS

This application is the national stage under 35 USC 371 of International Application No. PCT/GB2007/004574, filed Nov. 29, 2007, which claims the priority of United Kingdom Application No. 0625806.5, filed Dec. 22, 2006, the entire contents of both of which prior applications are incorporated herein by reference.

FIELD OF THE INVENTION

This invention relates to a hose and wand assembly for a surface treating appliance, such as a vacuum cleaner.

BACKGROUND OF THE INVENTION

Vacuum cleaners are typically of the upright or cylinder type. Cylinder cleaners consist of a main body containing a motor and fan unit for drawing an airflow into the main body and separating apparatus for extracting dirt and dust from the airflow and retaining it for disposal. The separating apparatus can be a cyclonic arrangement, bags, filters or a combination of these. A hose and wand assembly is connected to the inlet of the main body. A floor tool having a suction opening is attached to the end of the wand remote from the main body so that the suction opening can be manoeuvred across the surface to be cleaned by the user. Upright cleaners commonly have a cleaner head permanently attached to the main body of the vacuum cleaner which is manoeuvred, together with the main body, across the surface to be cleaned. However, many upright cleaners can also be operated in the manner of a cylinder machine by having a removable or releasable hose and wand assembly provided to which an accessory such as a floor tool can be attached.

Conventional floor tools typically comprise a housing which defines a downward-facing suction opening and in which is arranged a driven agitator in the form of a brush bar or beater, for example. Dirt and dust is dislodged from the carpet or other floor covering by the rotating brush bar or beater and the dirt and dust is drawn into the cleaner head by virtue of the suction produced by the downstream fan. Dirt laden air is then passed to the separation apparatus before clean air is expelled to the atmosphere.

The agitator may be driven by a dedicated motor, typically located on the floor tool. Power and signals may be provided between the main body and this dedicated motor by means of electrical connections. Conventionally, this is effected by means of wires running inside, or alongside, the hose and wand assembly.

It has been proposed to make vacuum cleaners more compact so that they can be more conveniently stored. To achieve a more compact cleaner for storage, it is known to provide a wand comprising a plurality of telescoping tubes. The tubes may be extended for use and retracted for storage. However, this type of telescoping wand is not suitable for use with vacuum cleaners requiring an electrical connection between the main body and a floor tool, owing to the difficulty of maintaining a reliable electrical connection between the sliding tubes.

SUMMARY OF THE INVENTION

The invention provides a hose and wand assembly for a surface treating appliance comprising a hose including at least one electrical conductor along at least part of its length and a wand comprising a plurality of tubes arranged to be slidably moveable with respect to each other between retracted and extended positions, the hose being connected to the wand such that, when the tubes are in the extended position, the hose extends inside at least part of the wand, and the narrowest tube includes an electrical connector projecting from the tube for connecting to components attachable to the wand assembly.

The provision of a hose incorporating electrical conductors that extends along the interior of the wand when the tubes are in a position for use in a cleaning operation automatically provides an electrical connection along the wand. The conductors extend beyond the end of the hose and terminate at the end of the wand in order to permit motor-driven tools to be connected to the end of the wand.

Preferably, the hose is connected to an end portion of the narrowest tube, this being the tube that is furthest from the user when the wand is in the extended position. Thus, a reliable electrical connection is provided across all the telescoping parts. Advantageously, the hose terminates just beyond the last telescoping joint between the narrowest tube and its neighbour. The hose need not extend beyond the last sliding connection between tubes and so terminating the hose at this point saves on materials.

The hose may incorporate a joint in the form of a slip ring between portions of the hose. The hose can be arranged so that this joint abuts an end of the wand when the tubes are in the extended position.

The term "surface treating appliance" is intended to have a broad meaning, and includes a wide range of machines having a head for travelling over a surface to clean or treat the surface in some manner. It includes, inter alia, machines which apply suction to the surface so as to draw material from it, such as vacuum cleaners (dry, wet and wet/dry), as well as machines which apply material to the surface, such as polishing/waxing machines, pressure washing machines, ground marking machines and shampooing machines. It also includes lawn mowers and other cutting machines.

BRIEF DESCRIPTION OF THE DRAWINGS

The invention will now be described, by way of example, with reference to the accompanying drawings, in which.

DETAILED DESCRIPTION OF THE INVENTION

Figure 1A:
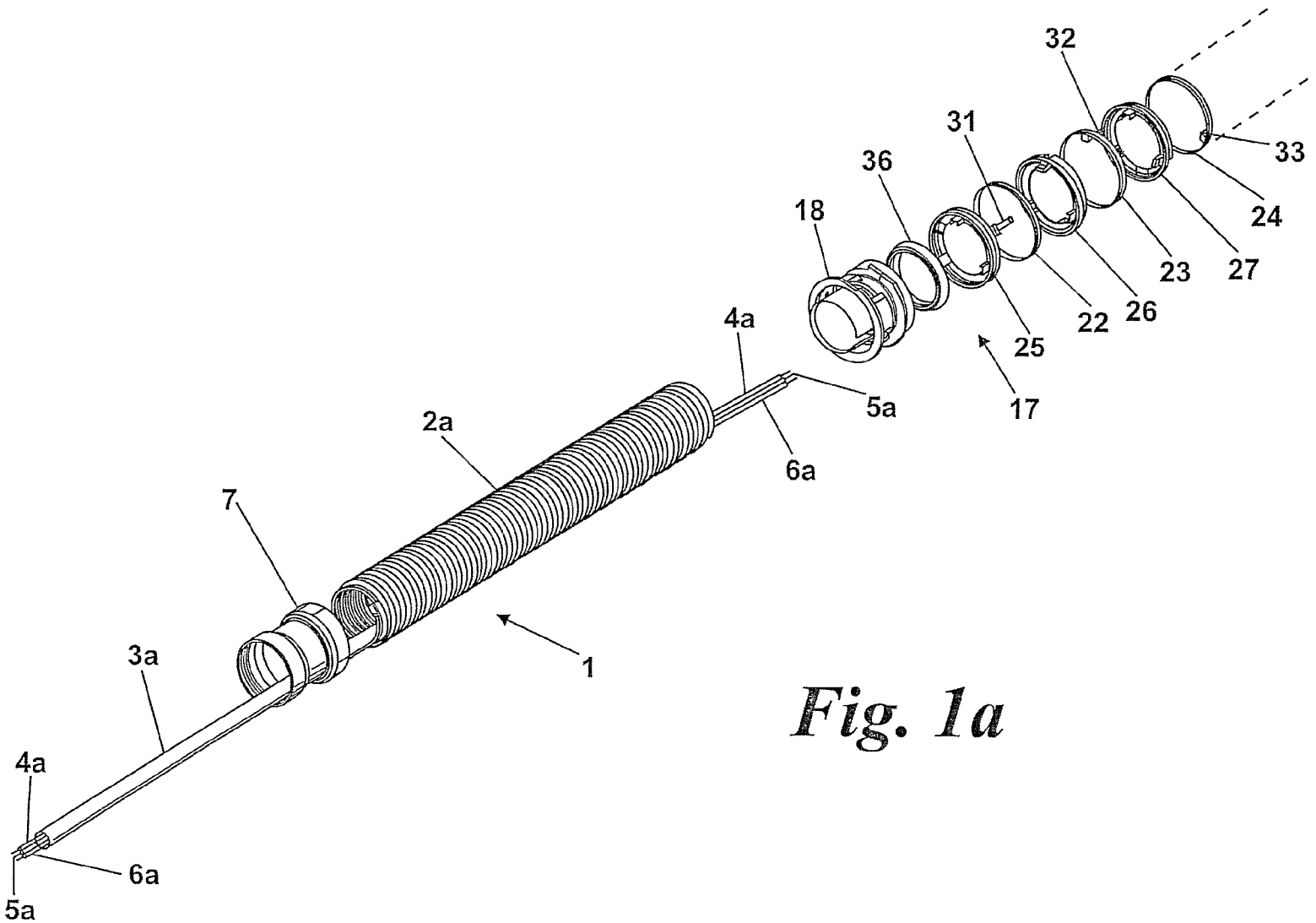
FIGS. 1*a* and 1*b* are exploded views of components of a hose assembly.

Like reference numerals refer to like parts throughout the specification.

Figure 1B:
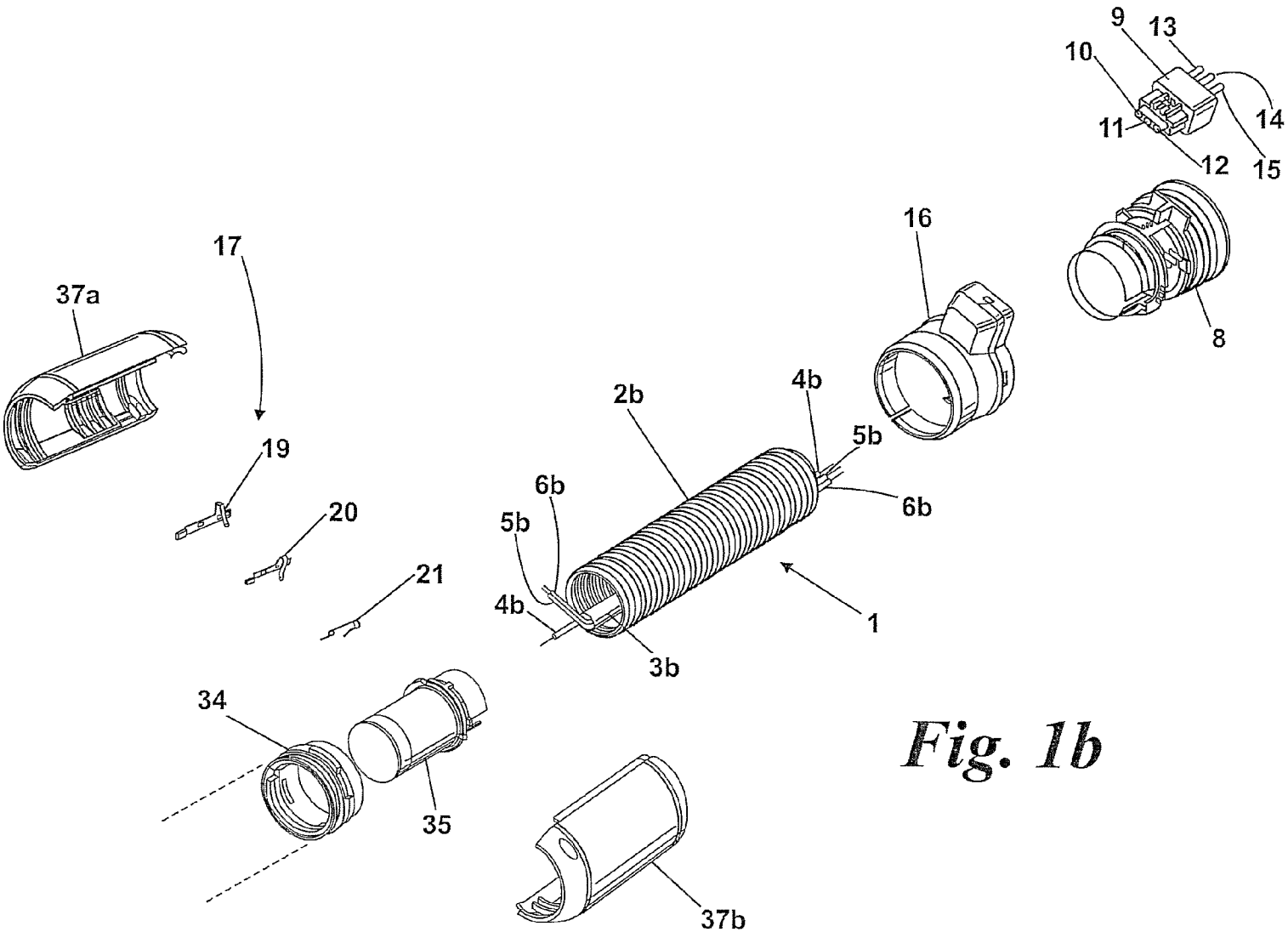

FIGS. 1*a* and 1*b* collectively illustrate components of the hose assembly, generally indicated by the reference numeral 1. In this embodiment, the hose assembly comprises a pair of hose portions 2*a*, 2*b*, although more portions may be provided. Only short sections of the hose portions 2*a*, 2*b* are shown in these drawings for clarity. Typically, the hose portions 2*a*, 2*b* would be much longer. Each hose portion 2*a*, 2*b* comprises a tube of corrugated plastics material, which is flexible and strong, and may be stretched. The hose portions 2*a*, 2*b* together form a fluid flow conduit.

Running along the interior of each hose portion 2*a*, 2*b* is a sleeve 3*a*, 3*b* respectively. The sleeves 3*a*, 3*b* are of relatively small diameter compared with the diameter of the hose portions 2*a*, 2*b*. The sleeves 3*a*, 3*b* are affixed to the inner walls of the hose portions 2*a*, 2*b*, such that each sleeve lies substantially parallel to the longitudinal axis of the hose portion to which it is affixed. The sleeves 3*a*, 3*b* may be glued to the hose portions 2*a*, 2*b*, heat-welded to them, or affixed by any other suitable means.

Each sleeve 3*a*, 3*b* is arranged to provide a protective housing for electrical conductors running along the sleeves. In this embodiment, three electrical conductors 4 (4*a* and 4*b*), 5 (5*a* and 5*b*) and 6 (6*a* and 6*b*) are provided, in order to permit transmission of power and signals along the hose assembly 1. Conductors 4*a*, 5*a* and 6*a* are located inside sleeve 3*a* and conductors 4*b*, 5*b* and 6*b* run inside sleeve 3*b*. The conductors 4, 5, 6 are electrically insulated from each other by means of plastic sheaths.

A wand connector 7 at one end of the hose portion 2*a* permits the hose assembly 1 to be connected to a wand, which shall be described later in the specification. The sleeve 3*a* sheathing the conductors 4*a*, 5*a*, 6*a*, extends beyond the wand connector 7.

At the opposite end of the other hose portion 2*b*, there is provided a main body connector 8, which permits the hose to be connected to the main body of an appliance, such as a vacuum cleaner. The connector 8 carries an electrical connector block 9. The ends of the conductors 4, 5, 6 terminate in apertures 10, 11, 12 in an end face of the connector block 9. The other end face carries pins 13, 14, 15, which connect electrically to the conductors 4, 5, 6 inside the block. The pins 13, 14, 15 provide a male connector for inserting into an appropriate female connector on the main body of the appliance. A cover 16 fits over the connector 8 and connector block 9, to protect the electrical connections from damage or tampering.

A joint 17 is provided between the hose portions 2*a*, 2*b*. Part of the joint 17 is shown in FIG. 1*a*, and part in FIG. 1*b*. The joint 17 permits the hose portion 2*b* to swivel with respect to the hose portion 2*a*. A first cuff 18, attached to the hose portion 2*a*, provides a termination for the conductors 4*a*, 5*a* and 6*a*. The ends of conductors 4*a*, 5*a* and 6*a* are electrically connected to contact arms 19, 20, 21. The electrical connection may be effected by crimping the ends of the conductors to the arms, soldering them, or any other suitable technique. The contact arms 19, 20, 21 are staggered in position both radially and axially along the cuff 18. The arrangement of contact arms 19, 20, 21 is more clearly visible in FIG. 2, which shows the components of the joint 17 as assembled. The cuff 18 and contact arms 19, 20, 21 are arranged to remain stationary with respect to the hose portion 2*a*.

Figure 2:
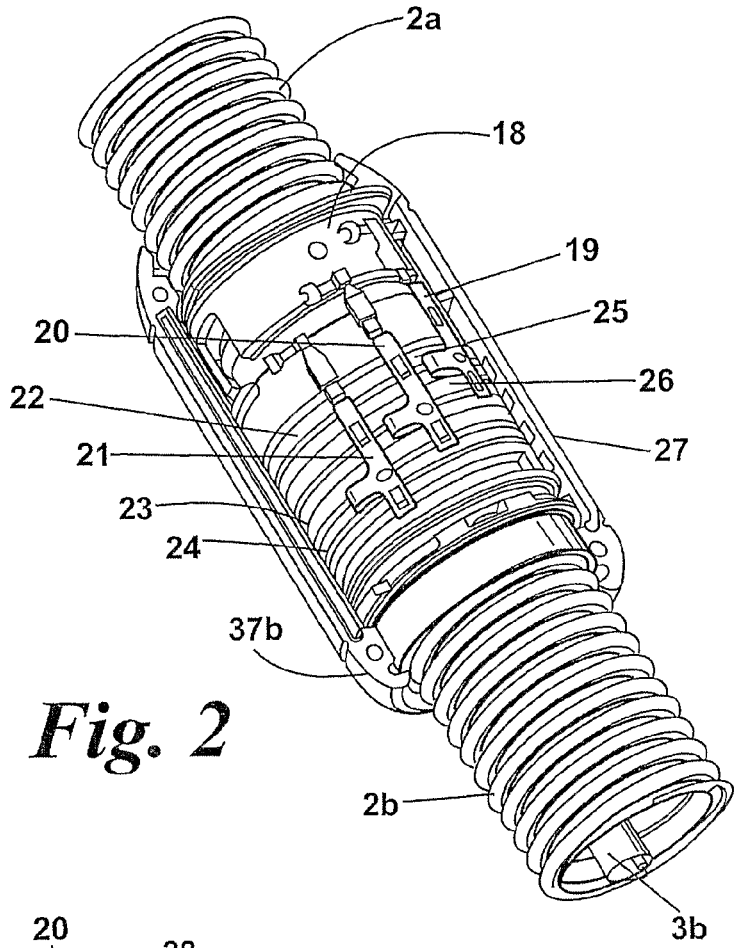
FIG. 2 is a partly cut-away perspective view of part of the hose assembly of FIG. 1.

The joint 17 further comprises three slip rings, 22, 23, 24, which are electrically conductive. The slip rings 22, 23, 24 are supported by support rings 25, 26, 27, which also serve to space the slip rings from each other. When the joint 17 is assembled, as can be seen in FIG. 2, the contact arm 19 contacts the slip ring 22, the arm 20 contacts the ring 23 and the arm 21 contacts the ring 24. In this manner, electrical contact between the conductors 4*a*, 5*a* and 6*a*, and the rings 22, 23 and 24 respectively is established.

Figure 3:
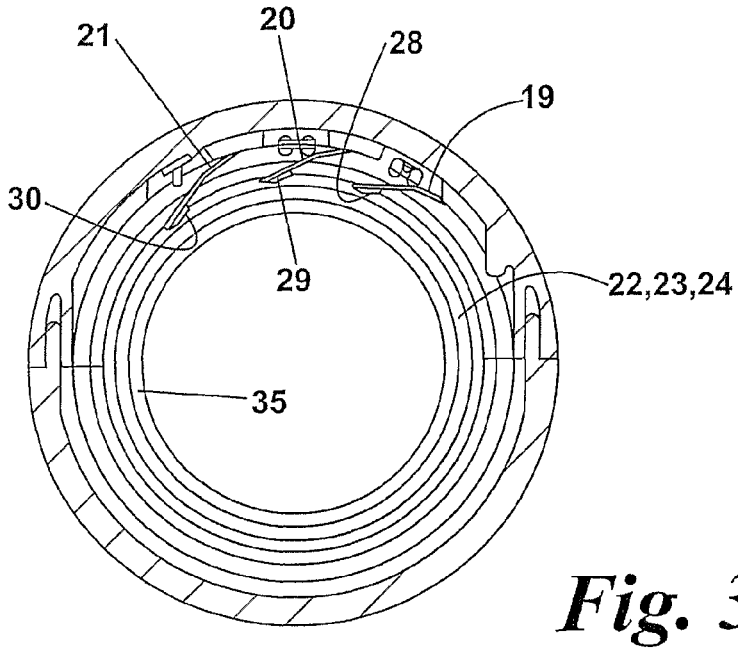
FIG. 3 is a partly cross-sectional view along the line A-A' of FIG. 2.

FIG. 3 is a partly sectional view along the line A-A' of FIG. 2, showing the contact made between the arms 19, 20, 21 and the slip ring arrangement. Each of the contact arms 19, 20, 21 is resiliently biased radially inwards. In this embodiment, this is achieved simply by bending the metal connector arms 19, 20, 21 radially inwards. Other biasing means, such as springs may be provided. The underside of each connector arm 19, 20, 21 carries a metal pad 28, 29, 30 respectively. The metal pads 28, 29, 30 are urged against the slip rings 22, 23, 24 respectively. The metal pads 28, 29, 30 each have a rounded profile to permit the slip rings 22, 23, 24 to move slidably with respect to the connector arms 19, 20, 21 in both clockwise and anticlockwise directions. Thus, the slip ring arrangement can swivel with respect to the hose portion 2*a*. In this manner, the joint 17 permits relative rotational movement between the hose portions 2*a* and 2*b*

The inner wall of the slip ring 22 carries a long metal tab 31 that extends axially under the support rings 26 and 27. The inner wall of the slip ring 23 carries a medium length metal tab 32 that extends parallel to the tab 31 under the support ring 27. The inner wall of the slip ring 24 carries a short metal tab 33 that also extends axially in the same direction as tabs 31 and 32. The three tabs 31, 32, 33 terminate at a second cuff 34, located at the opposite end portion of the joint 17 from the first cuff 18. The second cuff 34 is connected to the second portion 2*b* of the hose and provides an electrical connection between the tabs 31, 32, 33 and the conductors 4*b*, 5*b*, 6*b* associated with this hose portion 2*b*. The electrical connection may be effected by crimping the conductors to the tabs, soldering them together, or any other suitable method. Thus, an electrical connection is made between the conductors 4*a*, 5*a*, 6*a* and the conductors 4*b*, 5*b*, 6*b* respectively.

A conduit 35 is attached to the hose portion 2*b* and extends axially under the arrangement of slip rings 22, 23, 24 and support rings 25, 26, 27. The conduit 35 terminates in a seal 36, which abuts the first cuff 18. The conduit 35 is arranged to rotate with the slip ring arrangement and so swivels with respect to the cuff 18. The conduit 35 provides a fluid flow path between the two portions 2*a*, 2*b* of the hose.

Finally, a cover 37 comprising two cover members 37*a*, 37*b* is provided in order to cover and protect the electrical connections of the joint 17 and to hold together the components. The cover 37 also serves another purpose when employed with a wand and hose assembly constructed according to the second aspect of the invention, such as is illustrated in FIGS. 4 to 8.

Figure 4:
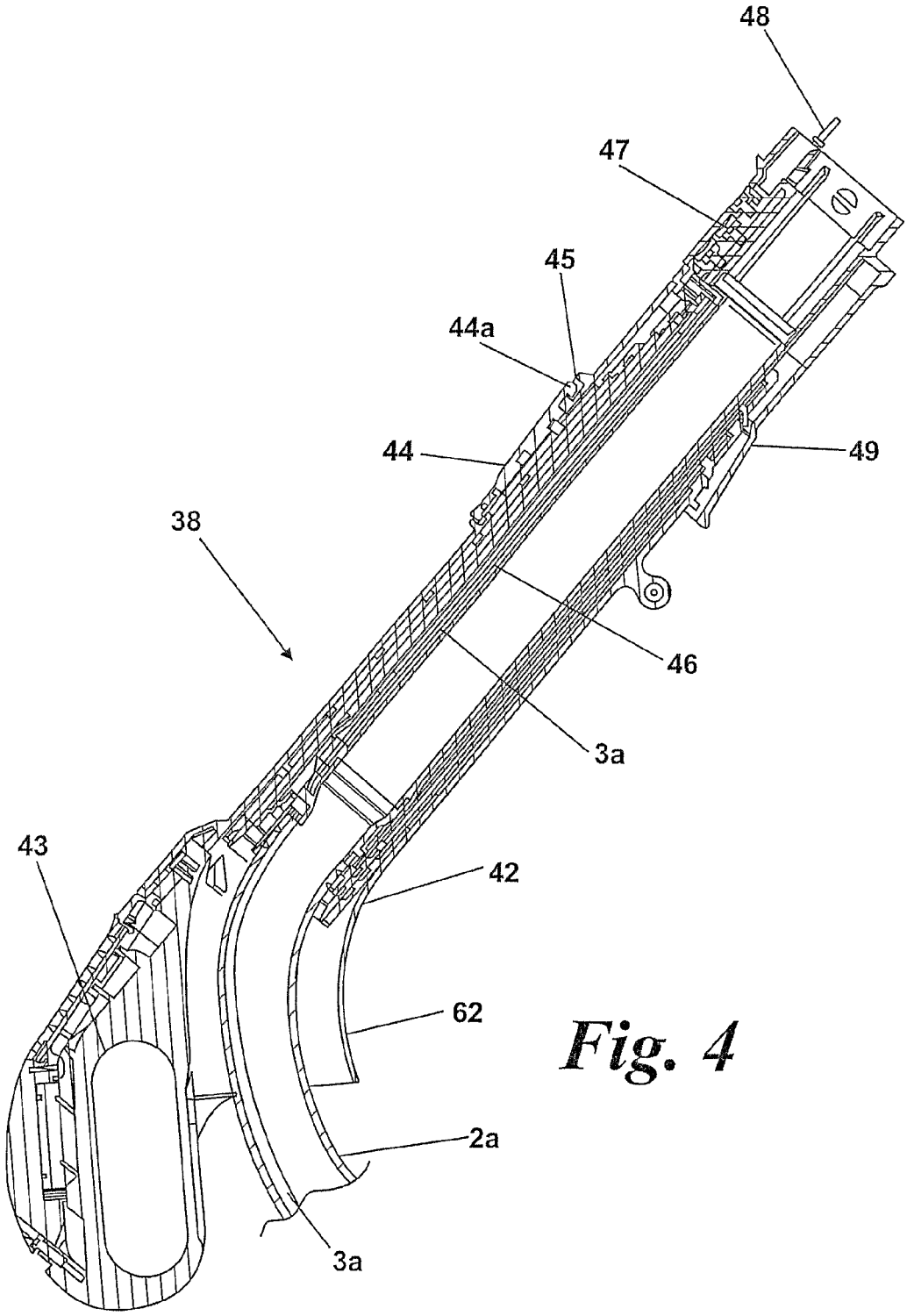
FIG. 4 is a partly sectional view of a hose and wand assembly constructed according to the invention, incorporating the hose of FIGS. 1 to 3, in a retracted position.
Figure 5:
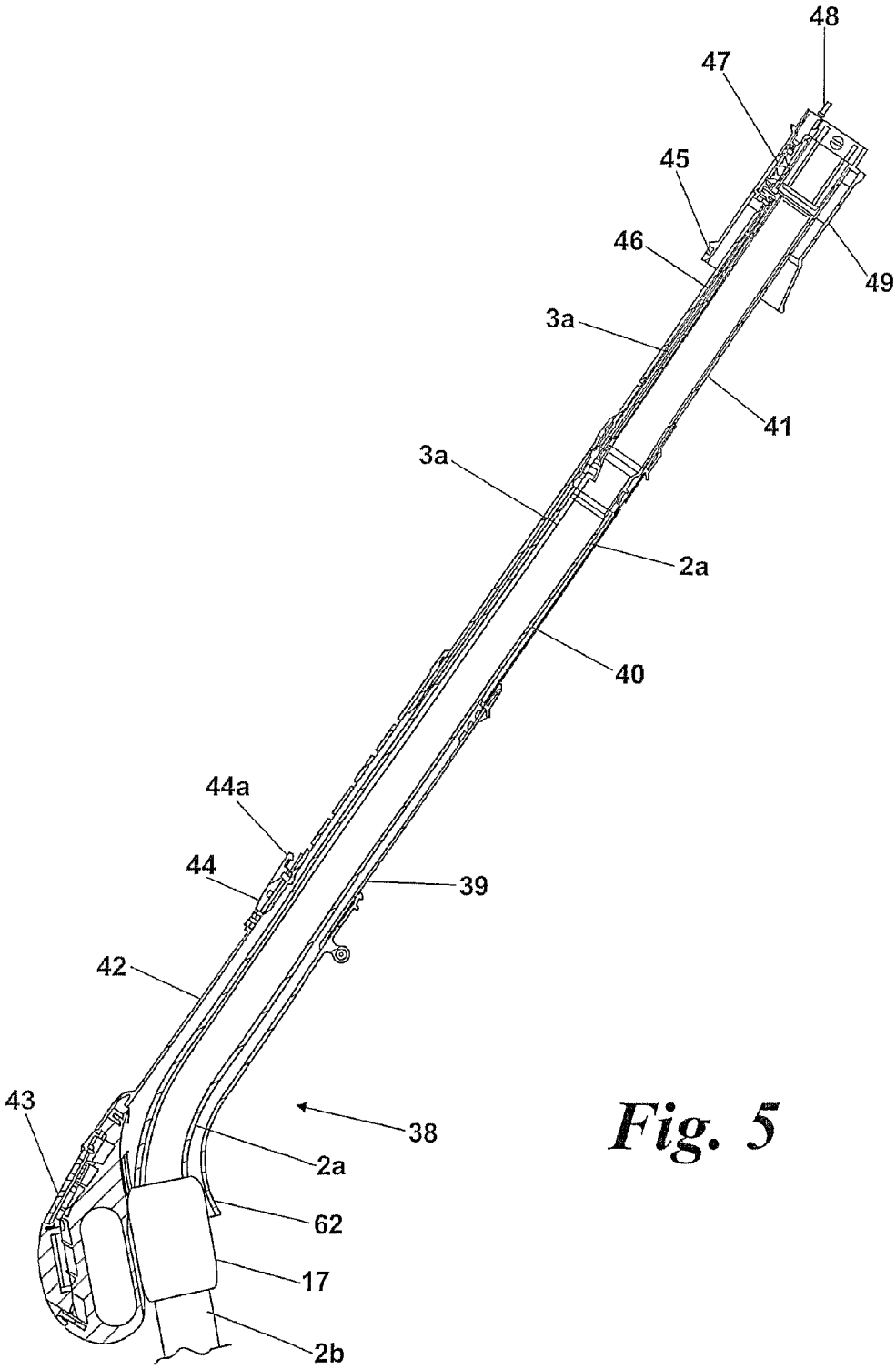
FIG. 5 is a partly sectional view of the hose and wand assembly of FIG. 4 in an extended position.

With reference to FIGS. 4 and 5, the wand assembly is indicated generally by the reference numeral 38. For clarity in these drawings, the hose portions 2*a* and 2*b* of the hose assembly 1 are shown without their corrugations. The wand assembly 38 comprises three separate tubes 39, 40, 41 of progressively decreasing diameter such that they can telescope inside one another. The three tubes 39, 40, 41 are retractably housed in a storage tube 42. A handle 43 is provided on the storage tube 42 to allow a user to manipulate the wand assembly 38.

Figure 6:
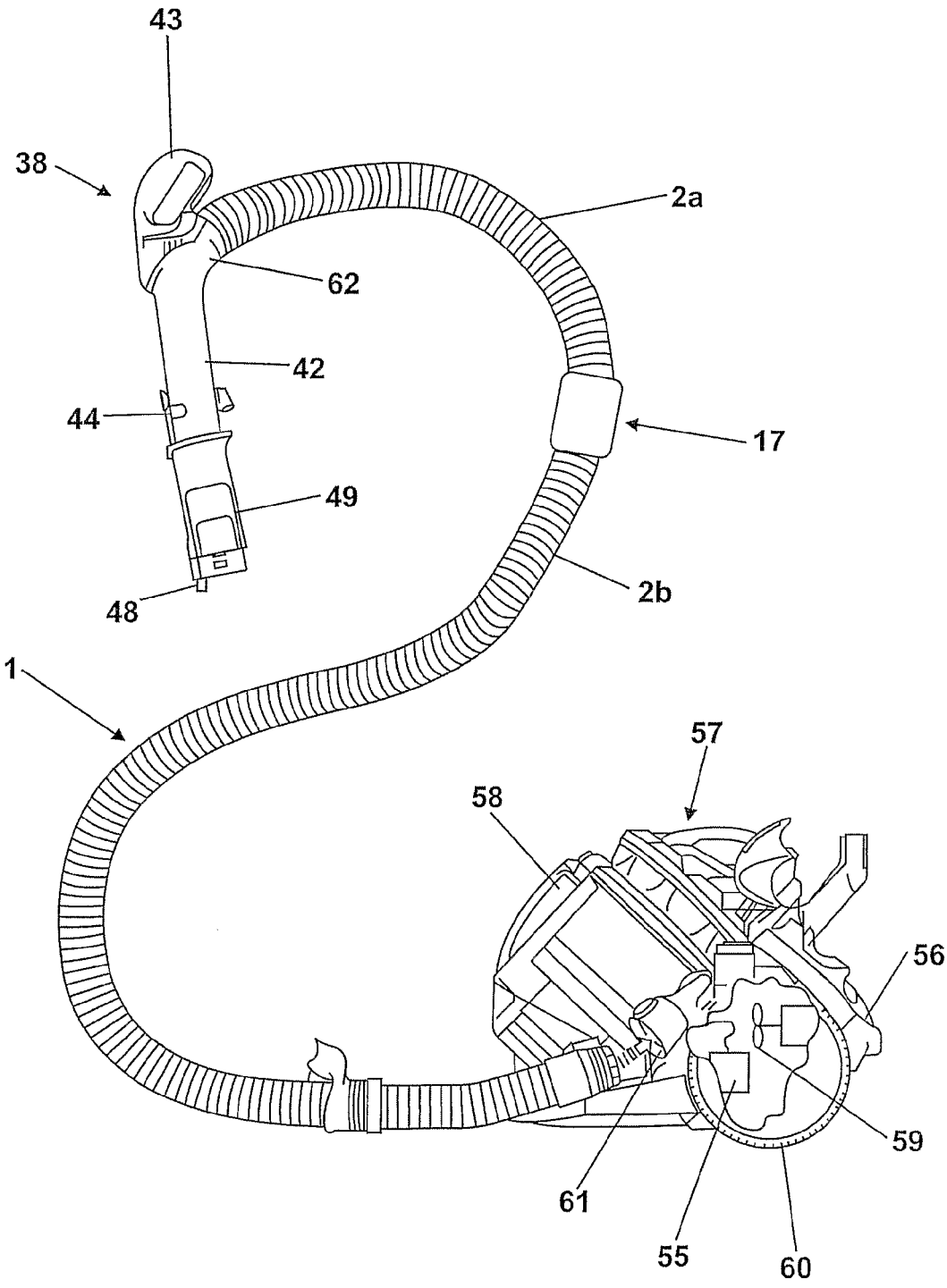
FIG. 6 illustrates a vacuum cleaner incorporating the hose and wand assembly of FIGS. 4 and 5, with the wand in a retracted position.
Figure 7:
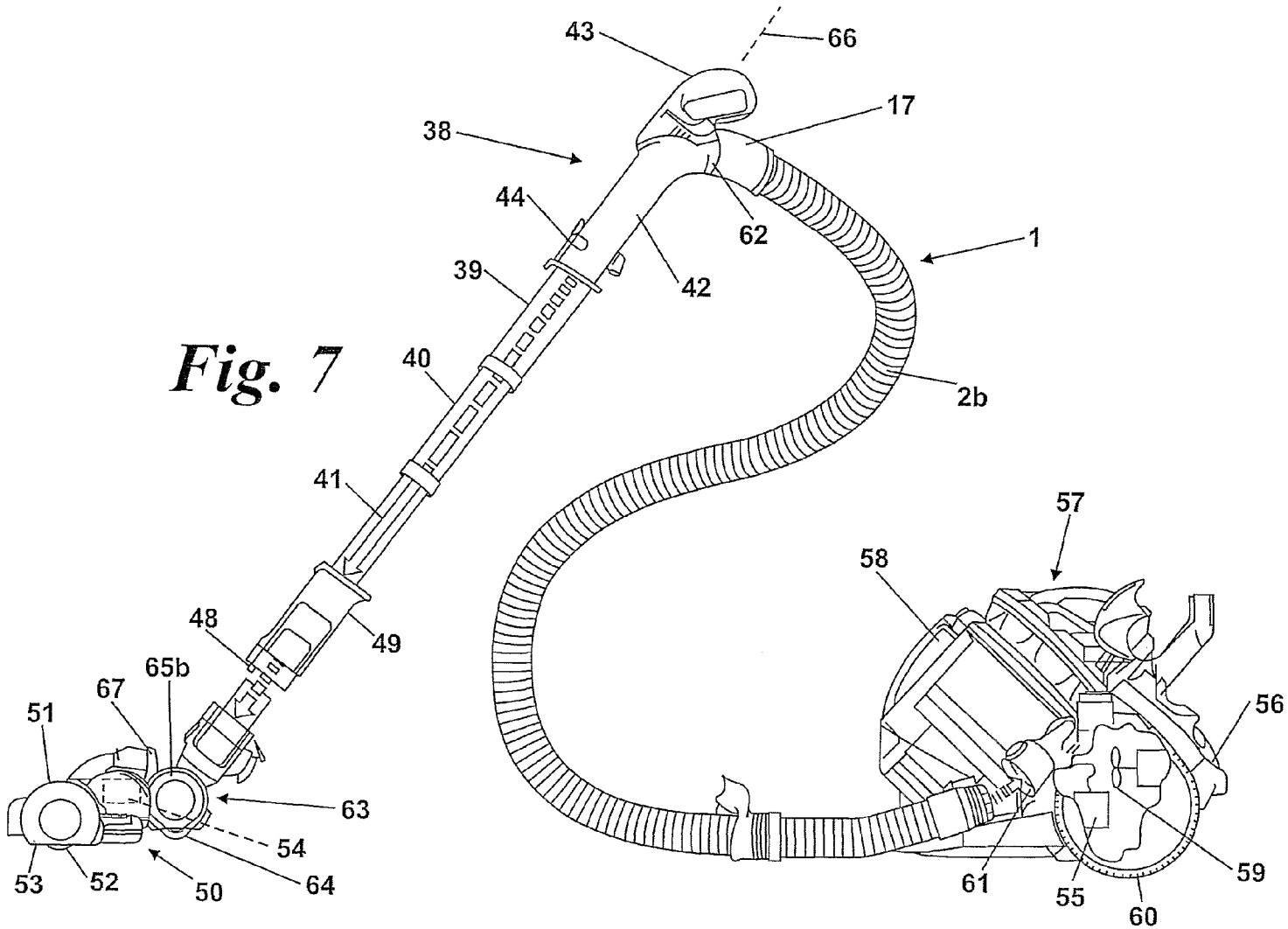
FIG. 7 illustrates the vacuum cleaner of FIG. 6 with the wand in an extended position.

The tubes 39, 40, 41 are slidable inside one another and can be moved between a retracted position (as shown in FIGS. 4 and 6) and an extended position (as shown in FIGS. 5 and 7). In the fully extended position, only the ends of the tubes 39, 40, 41 overlap one another. In the fully retracted position, the tubes 39, 40, 41 fit inside one another and occupy the storage tube 42.

A locking lever 44 is provided on the storage tube 42. Locking lever 44 carries a hook 44*a* which sits in a notch 45 on the distal end of the smallest tube 41 when the wand assembly 38 occupies the retracted position. The hook 44*a* and notch 45 arrangement securely hold the tubes 39, 40, 41 inside the storage tube 42 until the locking lever 44 is operated to release the hook 44*a*.

The mechanisms by which the tubes may be extended and retracted are not the subject of this patent application, and so will not be described in detail. A suitable arrangement of securing mechanisms that permit the tubes to move slidably with respect to each other and to lock in the extended position is described in our patent EP1365676. One of the advantages of employing such a wand arrangement is that complete extension and retraction of the wand can be performed in one continuous, swift movement without the need for a user separately to operate each securing mechanism.

In accordance with the invention, the hose 2 is connected to tube 41 such that, when the tubes 39, 40, 41 occupy the extended position, the hose portion 2*a*, which incorporates the electrical conductors 4*a*, 5*a* and 6*a*, extends along the interior of the wand assembly 38. Thus, a continuous electrical connection is made across the telescoping parts of the wand assembly in a straightforward manner. As a further benefit, the provision of the hose extending along the interior of the wand obviates the need for reliable sealing connections between the tubes of the wand.

Figure 8:
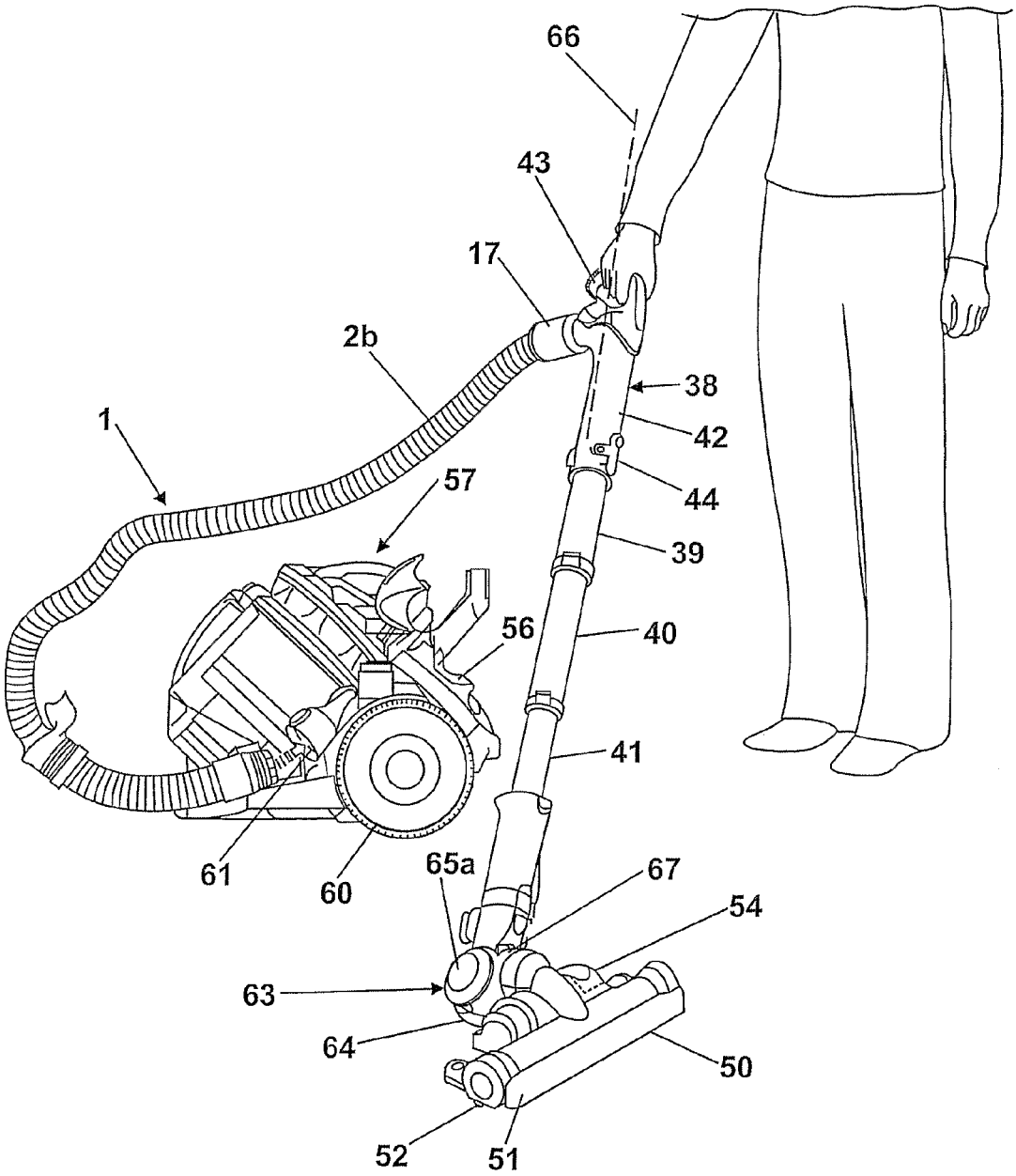
FIG. 8 illustrates the vacuum cleaner of FIGS. 6 and 7 in use.

The wand connector 7 on hose portion 2*a* is secured to an end of the tube 41 of smallest diameter. In this embodiment the wand connector 7 is attached to the proximate end of tube 41, viz the end that is nearer the tube 40, rather than the distal end of the tube 41. This is because the hose 2 need not extend beyond the connection between the tubes 40 and 41, as there are no further sliding or movable wand parts beyond this point. The sleeve 3*a* for the conductors 4*a*, 5*a*, 6*a* extends beyond the wand connector 7. The sleeve 3*a* is located inside a channel 46 running along the inner wall of the tube 41. A wand connector block 47 on the distal end of the tube 41 provides an electrical connection between the conductors 4*a*, 5*a*, 6*a* emerging from the end of the sleeve 3*a* and corresponding pins 48 protruding from the end of the wand assembly 38. The wand connector block 47 is incorporated in a flared cuff 49 at the distal end of the tube 41. The pins 48 form a male connector for connecting with, for example, a floor tool 50, which is shown in FIGS. 7 and 8.

The floor tool 50 comprises a housing 51 with a chamber for supporting an agitator in the form of a brush bar 52. The lower, floor-facing side of the chamber has an air inlet slot 53 and the brush bar 52 is rotatably mounted in the chamber such that bristles on the brush bar can protrude through the inlet slot and can agitate the floor surface over which the surface treating head passes. The brush bar 52 is rotatably driven by a dedicated motor 54 positioned on the rear of the housing 51.

The electrical conductors 4, 5, 6, which extend along the length of the hose and, consequently, the wand assembly in its extended position, provide power to the motor 54 and can also transmit signals between switches or other components on the floor tool 50 and an electronic processor 55, which, in this embodiment of the invention, is conveniently located on the main body 56 of a surface-treating appliance in the form of a vacuum cleaner 57.

The main body 56 of the vacuum cleaner 57 houses separating apparatus 58 and a motor-driven fan 59 for generating a suction airflow which can draw dirt-laden air into the separating apparatus. In this embodiment, the separating apparatus 58 comprises cyclonic separators which spin dirt, dust and debris from the airflow. Other forms of separator, such as a filter bag, an electrostatic separator or a liquid-based separator may be employed. The form of the separating apparatus 58 is not material to the invention. The main body 56 also has wheels 60 which allow the main body 56 to be pulled along a surface to be treated.

The connector 8 of the hose assembly 1 is connectable to the main body 56 by means of an inlet 61 on the main body 56. The main body 56 of the cleaner 57 may pulled along by the hose as a user moves around a room. The hose has a construction which is robust enough to withstand this pulling action, and any normal abrasion which may be encountered as the hose rubs against obstacles in a room. The pins 13, 14, 15 protruding from the connector 8 make electrical contact with a corresponding female connector (not visible in these drawings) in the inlet 61. Electrical connections inside the main body 56 connect the conductors in the hose to the electronic processor 55.

The electronic processor 55 may be arranged to perform a variety of functions. For example, the power transmitted to the agitator motor 54 may be regulated in dependence on the type of surface being treated. The processor 55 may be arranged to monitor the state of switches associated with the floor tool and the vacuum cleaner, in order to de-energise the agitator motor 54 or the main motor if the floor tool 50 or the cleaner 57 malfunctions or is being misused. The processor may also be arranged to record usage of the cleaner 57 and/or the floor tool 50 for diagnostic or research purposes. Data may be uploaded to the processor 55 in order to modify certain operating parameters of the appliance, for example the operating temperature at which the main motor de-energises.

In order to use the vacuum cleaner 57 and floor tool 50 for a cleaning operation, the user must extend the tubes 39, 40, 41 of the wand assembly 38 from the retracted position of FIG. 6 to the extended position of FIG. 7. In doing do, the hose 2 slides along the interior of the wand assembly 38 as previously described. During this movement, the joint 17 moves towards the wand assembly 38. When the wand assembly occupies the fully extended position of FIG. 7, the cover 37 of the joint 17 abuts the end of the storage tube 42. The end of the storage tube 42 may have a flared opening 62, to accommodate the rounded contours of the end of the cover 37. The cover 37 permits the hose 2 to swivel with respect to the wand assembly 38 and protects it from the wear and tear it might otherwise experience from being in close moving contact with the opening 62 of the storage tube 42. Furthermore, location of the joint 17 proximate the wand assembly 38 is a comfortable position for the user.

FIG. 8 shows the vacuum cleaner 57 and floor tool 50 in use. The floor tool further comprises a rolling support assembly 63 arranged to roll with respect to the housing 51, and which permits the head to be manoeuvred along a floor surface. The rolling support assembly 63 comprises a central roller 64 and a pair of outer rollers 65*a*, 65*b*, which are arranged relative to each other so as to provide a rolling support surface. In use, the user rotates the wand assembly 38 about its longitudinal axis 66 by means of the handle 42. This causes an axis of the rolling support assembly 63 to tilt with respect to the floor. A rotatable joint 67 located between the housing 51 and the rolling support assembly 63 permits the housing of the tool 50 to turn whilst remaining in contact with the floor. The extent to which the wand assembly 38 about the longitudinal axis 66 determines the extent to which the tool 50 moves from its forward facing position towards the right or left.

Variations may be made without departing from the scope of the invention. For example, the electrically conductive parts of the joint 17 may be arranged so that the slip rings remain stationary while the contact arms—and, consequently, the hose portion to which those arms are attached—are allowed to slide around the outer diameter of each slip ring. The contact arms may be arranged to contact the inner surface of the, or each, slip ring.

The invention has been described in relation to a joint in which one hose portion is affixed to a wand assembly, and so remains stationary, whilst the other hose portion is rotatable relative to it. The joint may alternatively be arranged so that both hose portions are able to move independently of each other.

The joint may be arranged to give relative swivelling movement over a predetermined range of angles, with stops preventing rotational movement beyond a predetermined point.

The invention has been described in a relation to a hose comprising two hose portions with one joint therebetween. Further hose portions, and joints between each portion, may be provided.

The hose and wand assembly may include more or fewer conductors and more or fewer tubes. Not all of the tubes of the wand assembly need be capable of telescopic movement relative to other tubes. The sleeve extending down the hose may be arranged to enclose other components. A further sleeve may be provided as a further fluid conduit arranged to allow, for example, water or cleaning fluid to flow along the wand and hose.

The invention claimed is:

1. A hose and wand assembly for a surface treating appliance, comprising a hose including at least one electrical conductor along at least part of its length, a wand comprising a plurality of tubes arranged to be slidably moveable with respect to each other between retracted and extended positions, and a storage tube in which the plurality of tubes may be stored when in the retracted position, the hose being connected to the wand such that, when the tubes are in the extended position, the hose extends inside at least part of the wand, and a narrowest tube of the plurality of tubes includes an electrical connector projecting from the narrowest tube for connecting to components attachable to the wand assembly.

2. The assembly of claim 1, in which the hose extends to an end portion of the narrowest tube.

3. The assembly of claim 2, in which the hose extends to the end portion of the narrowest tube that is closer to the adjacent tube.

4. The assembly of claim 1, 2 or 3, in which at least one conductor extends to the distal end of the wand when in the extended position.

5. The assembly of 1, further comprising a locking mechanism retaining the plurality of tubes in a retracted position within the storage tube.

6. The assembly of claim 1, further comprising securing mechanisms arranged to lock each tube in a predetermined position with respect to its adjacent tube.

7. The assembly of claim 1, further comprising a plurality of conductors extending along at least part of the length of the hose.

8. The assembly of claim 1, in which the at least one electrical conductor is carried by a sleeve in the hose.

9. The assembly of claim 1, in which the hose comprises first and second hose portions and a joint between the first and second hose portions arranged to permit relative rotational movement of the first and second hose portions.

10. The assembly of claim 9, in which, when the tubes are in the extended position, the joint is adjacent an end portion of the wand.

11. The assembly of claim 9, in which the joint has a protective cover.

12. The assembly of claim 9, in which the joint comprises a slip ring arrangement arranged to provide an electrical connection between the conductors in the respective hose portions.

13. The assembly of claim 1, further comprising a handle arranged to permit a user to manipulate the wand.

14. A surface treating appliance including the hose and wand assembly of claim 1.

15. The appliance of claim 14, further comprising a processor arranged to transmit power to the hose.

16. The appliance of claim 14, further comprising a processor arranged to transmit signals to the hose.

17. The appliance of claim 14, further comprising a processor arranged to receive signals from the hose.

18. The appliance of claim 14, further comprising a floor tool having a motor-driven agitator.

19. A vacuum cleaner comprising the surface treating appliance of claim 14.

20. A hose and wand assembly for a surface treating appliance comprising a hose including at least one electrical conductor along at least part of its length and a wand comprising an outer tube and an inner tube that is slidably moveable with respect to the outer tube between retracted and extended positions, the hose being connected to a first end of the inner tube of the wand such that, when the inner tube is in the extended position, the hose extends inside at least part of the outer tube, and wherein the inner tube includes an electrical conductor extending along the inner tube from said first end of the inner tube to a second end of the inner tube to an electrical connector, wherein the electrical connector projects from the second end of the inner tube for connecting to components attachable to the wand assembly.

21. The assembly of claim 20, further comprising a storage tube in which the inner and outer tubes may be stored when in the retracted position.

22. The assembly of claim 20 or claim 21, further comprising a locking mechanism retaining the inner tube in a retracted position.

23. The assembly of claim 20, further comprising a securing mechanism arranged to lock the inner tube in a predetermined position with respect to the outer tube.

24. The assembly of claim 20, in which a plurality of conductors extends along at least part of the length of the hose.

25. The assembly of claim 20, in which the at least one electrical conductor is carried by a sleeve in the hose.

26. The assembly of claim 20, in which the hose comprises first and second hose portions and a joint between the first and second hose portions arranged to permit relative rotational movement of the first and second hose portions.

27. The assembly of claim 26, in which, when the tubes are in the extended position, the joint is adjacent an end portion of the wand.

28. The assembly of claim 26, in which the joint comprises a slip ring arrangement arranged to provide an electrical connection between the conductors in the respective hose portions.

* * * * *